US012668975B2

(12) United States Patent
Noble

(10) Patent No.: US 12,668,975 B2
(45) Date of Patent: Jun. 30, 2026

(54) SYSTEM AND METHOD FOR ADJUSTING THE ALIGNMENT OF A FLAT PANEL

(71) Applicant: Pure Vista Ltd, Bodmin (GB)

(72) Inventor: Angus Noble, Totnes (GB)

(73) Assignee: Pure Vista Ltd, Bodmin (GB)

( * ) Notice: Subject to any disclaimer, the term of this patent is extended or adjusted under 35 U.S.C. 154(b) by 312 days.

(21) Appl. No.: 18/197,044

(22) Filed: May 13, 2023

(65) Prior Publication Data

US 2023/0417061 A1 Dec. 28, 2023

(30) Foreign Application Priority Data

Jun. 24, 2022 (GB) ..... 2209294

(51) Int. Cl.
*E06B 3/00* (2006.01)
*E04F 11/18* (2006.01)

(52) U.S. Cl.
CPC ..... *E04F 11/1817* (2013.01); *E04F 11/1853* (2013.01)

(58) Field of Classification Search
CPC ..... E04F 11/1853; E04F 11/1834
See application file for complete search history.

(56) References Cited

U.S. PATENT DOCUMENTS 11,156,000 B2 * 10/2021 Noble ..... E04F 11/1851
2015/0197959 A1 * 7/2015 Tinwala ..... E04F 11/1812
256/24
2015/0240851 A1 * 8/2015 Giacometti ..... E04F 11/1853
403/374.1
2016/0281366 A1 * 9/2016 Spence ..... E04F 11/1853
2017/0101784 A1 * 4/2017 Gonzato ..... E04F 11/1812
2017/0292274 A1 * 10/2017 Downs ..... E04F 11/1853
2018/0135669 A1 * 5/2018 Dagand ..... F16B 2/14
2019/0249442 A1 * 8/2019 Strehlow ..... E04F 11/1851
(Continued)

FOREIGN PATENT DOCUMENTS

DE 102018003366 10/2019
DE 202022104866 10/2022
(Continued)

OTHER PUBLICATIONS

UK IPO, Combined Search and Examination Report in corresponding GB Application 2209294.4, Dec. 20, 2022.
(Continued)

*Primary Examiner* — Basil S Katcheves
(74) *Attorney, Agent, or Firm* — Alley IP

(57) ABSTRACT

It is desirable to pivot a flat panel about an axis at or near the opening of a trough, so that the panel is not visibly closer to one side of the trough than the other. The present invention provides a tray 2,5 disposed within a trough 3, a panel socket 4,7 configured to engage with the tray such that movement of the tray along the trough in the longitudinal direction results in lateral movement of the panel socket within the trough, and a releasable wedge 95 configured to brace the panel 1 within the trough adjacent to the base 31 of the trough, the wedge configured to bridge a gap between the base of the flat panel and a wall 51 of the tray. In this way, the wedge urges the wall of the tray against the side wall of the trough, thereby resisting movement of the tray within the trough.

8 Claims, 14 Drawing Sheets

(56) References Cited

U.S. PATENT DOCUMENTS

| | | | | |
|---|---|---|---|---|
| 2020/0109568 | A1* | 4/2020 | Downs | E04F 11/1812 |
| 2021/0246664 | A1* | 8/2021 | Hilliaho | E04F 13/0805 |
| 2022/0127856 | A1* | 4/2022 | Chapel | E04F 11/1812 |
| 2022/0195734 | A1* | 6/2022 | Giacometti | E04F 11/1834 |

FOREIGN PATENT DOCUMENTS

| | | |
|---|---|---|
| EP | 3816362 | 5/2021 |
| GB | 2566303 | 3/2019 |

OTHER PUBLICATIONS

EPO, Extended European Search Report in corresponding EP application 23171963.4, Nov. 29, 2023.

* cited by examiner

SYSTEM AND METHOD FOR ADJUSTING THE ALIGNMENT OF A FLAT PANEL

RELATED APPLICATIONS

This application claims priority under 35 U.S.C. § 119 to GB Application GB2209294.4, filed Jun. 24, 2022, such GB Application also being incorporated by reference herein in its entirety.

FIELD

The present invention relates generally to a system and method for adjusting the alignment of a flat panel and finds particular, although not exclusive, utility in alignment of glass panels.

BACKGROUND

Panels, in particular flat panels, are often made of glass, acrylic, metal, plastics material and/or other hard materials. Such panels may comprise two opposing faces, which may be flat or may be curved, regular or irregular, and a perimeter wall joining the two opposing faces. The perimeter wall may comprise a base.

It is known for balustrades and partitions to be formed from a flat panel and for such panels to be anchored along a lower edge and substantially unsupported at an upper edge. Known methods of supporting these panels include placing a lower edge into a trough and clamping the panel in place.

It is desirable for these panels to be arranged/aligned vertically, both for aesthetic reasons, and to ensure that their centre of mass acts through their footprint, thereby reducing constant torque on their support mechanisms. Conventionally, this has been achieved by ensuring that the trough is itself precisely aligned on a horizontal, such that any flat panel inserted therein stands in a vertical plane.

Various systems are known for supporting a flat panel in a vertical alignment, whereby the angle of the panel can be adjusted after insertion. Thus, a trough may be placed on an approximately horizontal surface, or a surface that may be subject to subsidence, and for alignment of a panel to be achieved at a later point.

However, these often involve the panel being pivoted about its base, and therefore the panel may be visibly closer to one side of the trough than the other, at the upper opening of the trough. It is therefore desirable to pivot the panel about an axis at or near the opening of the trough; however, this requires lateral movement of the panel at a base of the trough, which is difficult to access.

SUMMARY

According to a first aspect of the present invention, there is provided a system for adjusting the alignment of a flat panel, the system comprising: a longitudinal trough having two opposing side walls and a base connected therebetween, the trough being open on a side opposing the base, the trough configured to be attachable to a surface; a tray disposed within the base of the trough, the tray comprising a wall extending upward from the base of the trough adjacent to a first one of the side walls of the trough; a panel socket configured to receive a base of a flat panel therein, the panel socket configured to grip the base of the flat panel, the panel socket and the tray arranged to be slidable relative to one another, wherein the panel socket is configured to engage with the tray such that movement of the panel socket or the tray along the trough in the longitudinal direction results in lateral movement of the panel socket within the trough; a clamp configured to hold the panel within the trough adjacent to the open side of the trough; and a releasable wedge configured to brace the panel within the trough adjacent to the base of the trough, the wedge configured to bridge a gap between the base of the flat panel and the wall of the tray.

In this way, the wedge provides an outwardly biased force that urges the wall of the tray against the first one of the side walls of the trough, thereby resisting movement of the tray within the trough.

The system may additionally comprise the flat panel. However, alternatively the system excludes the flat panel and is for use with a flat panel. The flat panel may comprise glass. The flat panel may be substantially planar. The flat panel may have a length and a height each substantially greater than a width of the flat panel; for example, the length and height may exceed the width by a factor of at least ten, fifty or one hundred. The flat panel may be inserted into the trough with its length aligned along a longitudinal axis of the trough, and its width extending laterally across the trough, and its height projecting out of the trough.

Such flat panels may have two opposing major faces, joined around a perimeter by for instance four or more minor faces. The major faces may define the plane of the panel, and the minor faces may define an edge of the panel. The major faces are substantially larger than the minor faces. The present invention may be usable with one or more shims and/or spacers located with a flat panel, for instance, against a major face of the flat panel. In particular, a shim/spacer may be placed between the flat panel and the panel socket, such that the panel socket may be used with flat panels having differing thicknesses. Alternatively or additionally, the panel socket may be adjustable for use with flat panels having different thicknesses. In some embodiments, the panel socket may comprise one or more of such shims/spacers. Each shim/spacer may be a flat sheet, which in some circumstances may be tapered or wedged, but is preferably of substantially uniform thickness. The shim/spacer may be made of metal, aluminium, silicone, rubber, synthetic rubber, wood, plastic material, composite material or any other suitable material. The shim/spacer may be approximately 1 mm, 2 mm, 2.5 mm, 3 mm, 4 mm or 5 mm thick (i.e. between major faces). A single or multiple shims/spaces may be used adjacent to a flat panel.

The alignment of a flat panel to be adjusted may comprise an inclination of the panel; that is, an angle the panel makes with the vertical. For example, turning forces may act to weaken or degrade the panel, trough and/or components of the system if the panel is not entirely vertical. In particular, the system may be configured to adjust the tilt of the panel about the longitudinal axis of the trough.

The trough may have a longitudinal axis, and may be substantially longer in a length parallel to the longitudinal axis than in a width or depth at right angles to the longitudinal axis. The side walls may extend along respective sides of the trough, parallel to the longitudinal axis. Similarly, the base may extend between the side walls, also substantially parallel to the longitudinal axis. Ends of the trough may be open or closed; that is, the ends substantially perpendicular to the side walls, the base and the longitudinal axis. The trough may be open on a side substantially opposing the base; that is, the side walls may be connected to one another at the base, and optionally the ends, but not at substantially any additional point. The open side opposing the base may be referred to as the top, even when the trough is located on a surface that is substantially non-horizontal, or is affixed to a surface at a non-zero angle to the base of the trough. The side walls may be spaced from one another. The trough may be integrally formed, formed by extrusion, moulding, or may be assembled from component parts, for instance by welding, bolting, screwing, gluing, etc. The trough may comprise a channel.

The trough may have a tapered cross-section; that is an internal width of the trough adjacent to the base may be less than an internal width of the trough adjacent to the open top. In particular, an internal width of the trough approximately mid-way up may be more than an internal width of the trough adjacent to the base.

The trough may be configured to be removably or substantially permanently attachable to a surface. The trough may be configured to be set into a trench in a surface, such that the open side of the trough is substantially level with the surface. The trough may be attached to a surface such that it is horizontal; however, the present invention is capable of use when the trough is attached to a surface such that it is substantially non-horizontal. The trough may be screwed, glued, cemented, bolted or otherwise fixed to and/or into a surface.

Lateral movement may comprise movement in a direction substantially perpendicular to the longitudinal direction, and in particular may comprise movement parallel to the base and/or the opening of the trough (i.e. movement that is a constant distance from the base and/or the opening of the trough).

The tray may be inhibited from lateral movement within the base of the trough. For example, the tray may extend laterally entirely across a base of the trough so that lateral movement is prevented by the side walls thereof. Alternatively or additionally, the tray and the base of the trough may be provided with cooperating profiles, which may include rails and/or grooves, that prevent lateral movement.

The wall extending upward from the base of the trough may extend all the way to the opening of the trough. However, in alternative embodiments, the wall may extend only part-way up the first one of the side walls of the trough.

The panel socket may include at least one tab, a projection that extends from a top thereof toward the opening of the trough. The at least one tab may be usable to move the panel socket in a longitudinal direction within the trough, and/or to remove and re-insert the panel socket from/into the trough.

The clamp and/or the wedge may be arrangeable between two tabs of the panel socket, such that movement of the clamp and/or the wedge along the trough in a longitudinal direction also moves the panel socket in the same direction relative to the tray, thereby resulting in lateral movement of the panel socket within the trough, thereby changing the angle of inclination of the panel within the trough.

The tray may include at least one tab, a projection that extends from a top thereof toward the opening of the trough. The at least one tab may be usable to move the tray in a longitudinal direction within the trough, and/or to remove and re-insert the tray from/into the trough. The tab may form part of, or extend from, the wall of the tray.

The panel socket may securely hold a periphery of a flat panel, for instance a portion of the flat panel adjacent to a lower edge of the panel. The panel socket may engage a face of the flat panel immediately adjacent to a lower edge of the panel.

The tray may support a portion of the weight of the flat panel, via walls of the tray engaging a face of the flat panel immediately adjacent to a lower edge of the panel.

The panel socket may comprise a relatively high-friction surface for securely holding a section of the flat panel. The panel socket may comprise rubber material, synthetic rubber material, silicone rubber material and/or any other suitable form of resilient material. The contact surface may be substantially planar and/or flat. The contact surface may be substantially smooth; however, in preferred embodiments the contact surface is textured. For instance, the contact surface may comprise ridges, protuberances and/or dimples.

The panel socket may comprise a relatively low-friction surface for engaging with the tray. The tray may equally comprise a relatively low-friction material.

Movement of the panel socket with respect to the tray may be substantially diagonal. That is, in the reference frame of the tray, the panel socket may be constrained to move diagonally with respect to the longitudinal axis.

The panel socket and the tray may be provided with respective cooperating angled ramps against which the panel socket and the tray may slide relative to one another. However, other mechanisms are envisaged, such as ratchet mechanisms. The angled ramps may comprise a lip in a vertical profile of the angled ramps, to prevent any relative vertical movement and/or vertical detachment of the panel socket and the tray.

The clamp may comprise a first jaw and a second jaw, the second jaw configured to be moveable toward the first jaw to grip a panel therebetween.

The first jaw and/or the second jaw may be mounted on the trough, adjacent to the open side of the trough, and/or on respective opposing side walls of the trough.

The first jaw may be located on the first or second side wall of the trough. The first jaw may comprise a first panel contact pad, which may be configured to grip the panel. The first jaw may comprise an adjustment part, for varying a distance of the panel contact pad from the side wall of the trough. The adjustment part may comprise an externally threaded shank and a corresponding internally threaded aperture into which the externally threaded shank is operatively engaged. In this way, rotation of the threaded shank in the threaded aperture (or vice versa) varies an amount of insertion of the threaded shank within the threaded aperture.

For example, the threaded aperture may be fixedly mounted on the panel contact pad, and the threaded shank may extend therefrom to the side wall of the trough. For this purpose, the threaded shank may be provided with a rotation drive, such as a bolt head or screw drive, to enable manual rotation of the threaded shank. Alternatively, the threaded shank may be fixedly mounted on the panel contact pad, and the threaded aperture may extend therefrom to the side wall of the trough. For this purpose, the threaded aperture may be provided with a rotation drive, such as a bolt head or screw drive, to enable manual rotation of the threaded aperture.

The second jaw may be located on the second or first side wall of the trough, opposing the first jaw. The second jaw may comprise a second panel contact pad, which may be configured to grip the panel. The second jaw may comprise an adjustment part similar or different to the adjustment part of the first jaw. However, in preferrable arrangements, the second jaw is pivotally attached to the side wall of the trough, and may be of fixed size.

The first jaw may be arranged directly opposite the second jaw, or may be arranged obliquely, such that a line of extension of the adjustment part passes the second jaw, for example without intersecting therewith. In this way, the force provided by the clamp may comprise a clamping component (that acts between the first jaw and the second jaw) and a bedding component (that acts along the panel toward the base of the trough.

The clamp may produce a force having a bedding component that acts along the panel toward the base of the trough. In this way, security of the panel can be improved.

In particular, the first jaw may be arranged to abut an interior surface of the wall of the trough that faces away from the opening of the trough (e.g. orientated partially toward the base of the trough). However, alternatives in which the first jaw is fixedly mounted on the wall of the trough obviate the need for the interior surface of the wall of the trough to face away from the opening of the trough.

The releasable wedge may comprise a body having a substantially flat panel contact surface, and a wall contact surface. The releasable wedge may be tapered, in that it may be provided with a narrow end and a wide end, where a distance between the panel contact surface and the wall contact surface is smaller at the narrow end than at the wide end.

Depending on the lateral position of the panel within the base of the trough, the releasable wedge may be more or less inserted between the panel and the wall of the tray. That is, when the panel is further from the wall of the tray, the wedge is inserted further toward the base of the trough, and when the panel is closer to the wall of the tray, the wedge is inserted less far toward the base of the trough.

In preferred arrangements, the releasable wedge is coupled to the first jaw, and in particular the first panel contact pad. The releasable wedge may be integrally formed with the first panel contact pad.

The bedding component of the force from the clamp may act to urge the releasable wedge into the gap between the base of the flat panel and the wall of the tray.

In this way, securing the panel at the opening with the clamp also secures the base of the panel with the releasable wedge.

According to a second aspect of the present invention, there is provided a method for adjusting the alignment of a flat panel, the method comprising the steps of: providing the system according to the first aspect; placing a flat panel in the panel socket; sliding the panel socket and tray relative to one another along the trough in a longitudinal direction, thereby moving the panel socket laterally within the trough; holding the panel with the clamp adjacent to the open side of the trough; and bracing the panel with the releasable wedge adjacent to the base of the trough.

According to a third aspect of the present invention, there is provided a system for adjusting the alignment of a flat panel, the system comprising: a longitudinal trough having two opposing side walls and a base connected therebetween, the trough being open on a side opposing the base, the trough configured to be attachable to a surface; a tray disposed within the base of the trough, the tray comprising a wall extending upward from the base of the trough adjacent to a first one of the side walls of the trough; a panel socket configured to receive a base of a flat panel therein, the panel socket configured to grip the base of the flat panel, the panel socket arranged to be slidable along the trough in a longitudinal direction, wherein the panel socket is configured to engage with the tray such that movement of the panel socket along the trough in the longitudinal direction results in lateral movement of the panel socket within the trough; and a clamp configured to hold the panel within the trough adjacent to the open side of the trough.

According to a fourth aspect of the present invention, there is provided a method for adjusting the alignment of a flat panel, the method comprising the steps of: providing the system according to the third aspect; placing a flat panel in the panel socket; sliding the panel socket along the trough in a longitudinal direction, thereby moving the panel socket laterally within the trough; and holding the panel with the clamp adjacent to the open side of the trough.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION

Figure 1:
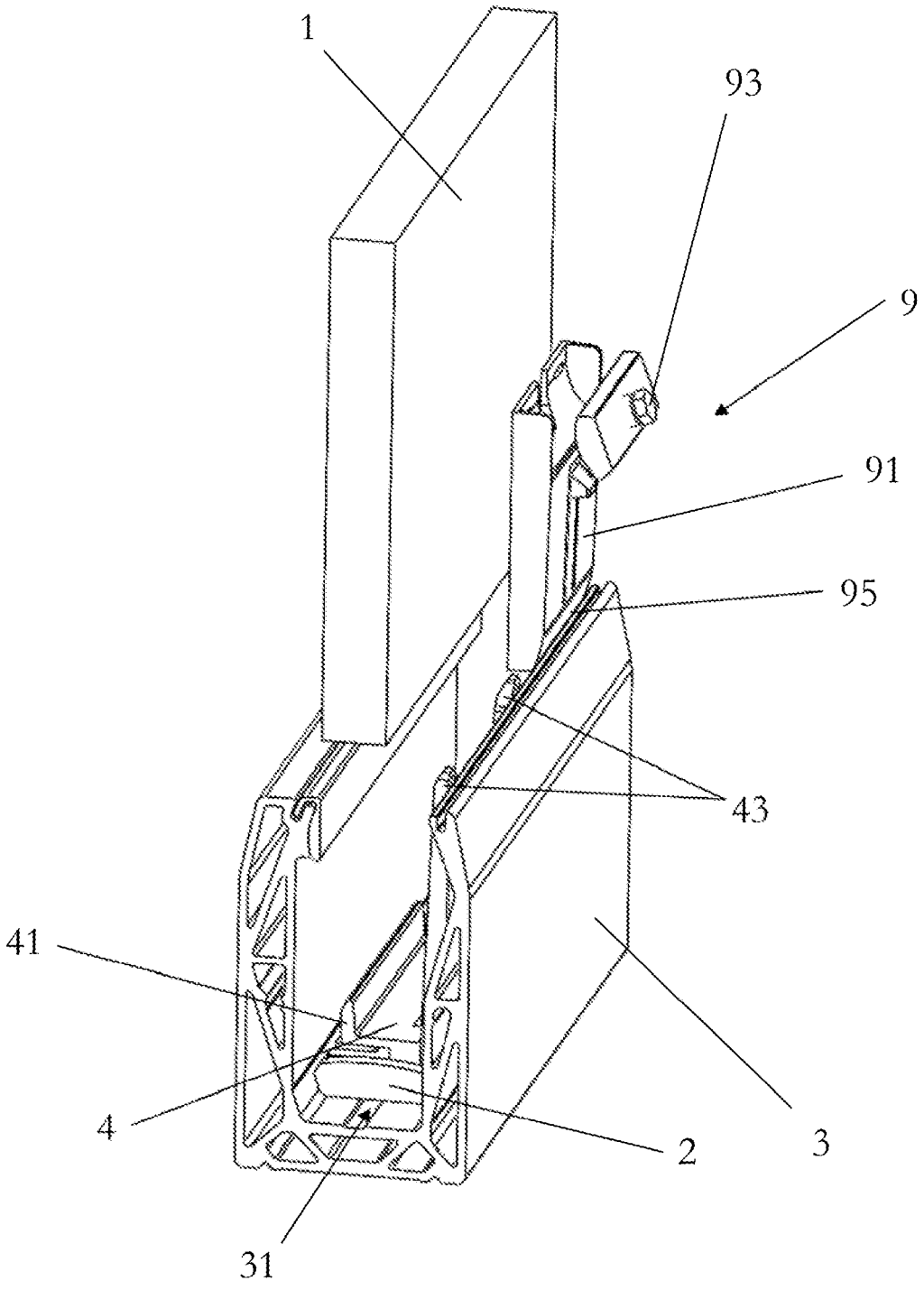
FIG. 1 is a partially exploded view of a system for adjusting the alignment of a flat panel.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein. Likewise, method steps described or claimed in a particular sequence may be understood to operate in a different sequence.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Similarly, it is to be noticed that the term "connected", used in the description, should not be interpreted as being restricted to direct connections only. Connected" may mean that two or more elements are either in direct physical or electrical contact, or that two or more elements are not in direct contact with each other but yet still co-operate or interact with each other.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any one embodiment or aspect of the invention may be combined in any suitable manner with any other particular feature, structure or characteristic of another embodiment or aspect of the invention, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances. The use of the term "any" may mean "all" and/or "each" in certain circumstances.

The principles of the invention will now be described by a detailed description of at least one drawing relating to exemplary features. It is clear that other arrangements can be configured according to the knowledge of persons skilled in the art without departing from the underlying concept or technical teaching, the invention being limited only by the terms of the appended claims.

FIG. 1 is a partially exploded view of a system for adjusting the alignment of a flat panel 1. The flat panel 1 is shown with significantly reduced height and length than would be typical, purely for the sake of clarity. In fact, a single panel may be gripped by multiple such systems along its length.

The system includes a trough 3, into which the flat panel 1 is to be mounted. A tray 2 is inserted into the base 31 of the trough 3. A panel socket 4 is shown ready to receive the base of the panel 1, with panel socket wall 41 arranged to wrap around one side of the panel 1. A clamping part 9 is shown next to the panel 1, and includes a panel contact pad 91, an adjustment part 93 and releasable wedge 95.

Figure 2:
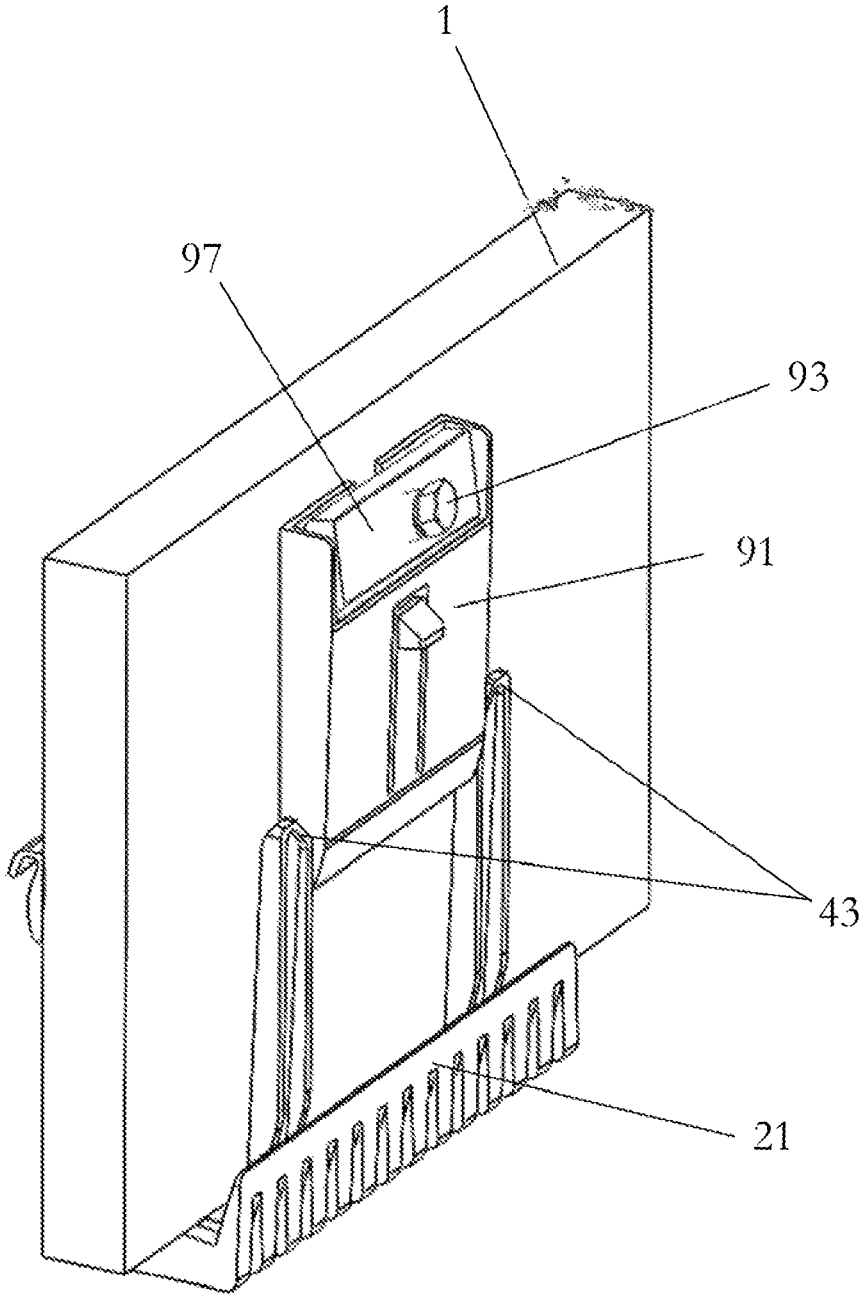
FIG. 2 shows the system of FIG. 1 partially assembled, but with the trough absent.

FIG. 2 shows the system of FIG. 1 partially assembled on the panel 1, but with the trough 3 absent. The panel 1 is shown with a tray wall 21 of the tray 2 extending around one side of the panel 1. The panel socket 4 is itself engaged in the tray 2.

The releasable wedge 95 is located in contact with the panel 1 (by virtue of the contact pad 91, or which it forms part) and in between the interiors of the two tabs 43 extending upwards from the base of the panel socket 4.

The adjustment part 93 is shown as a hexagonal head of a bolt, the bolt passing through an internally-threaded aperture (not shown) in a plate 97. The plate 97 acts to spread a force from the bolt over the entire width of the contact pad 91. The bolt extends into the aperture at an oblique angle; that is, extending in part horizontally (toward the panel) and in part vertically (toward the base of the trough). The bolt head is configured to abut an interior of the trough when extended out from the aperture, such that the bolt pushes the plate 97, and thereby the contact pad 91 into contact with the panel 1, and also pushes the contact pad 91 downward. The downward action of the contact pad 91 acts to urge the panel 1 into the base of the trough, and also acts to urge the wedge 95 into bracing the panel 1 against the upwardly extending wall 21.

Figure 3:
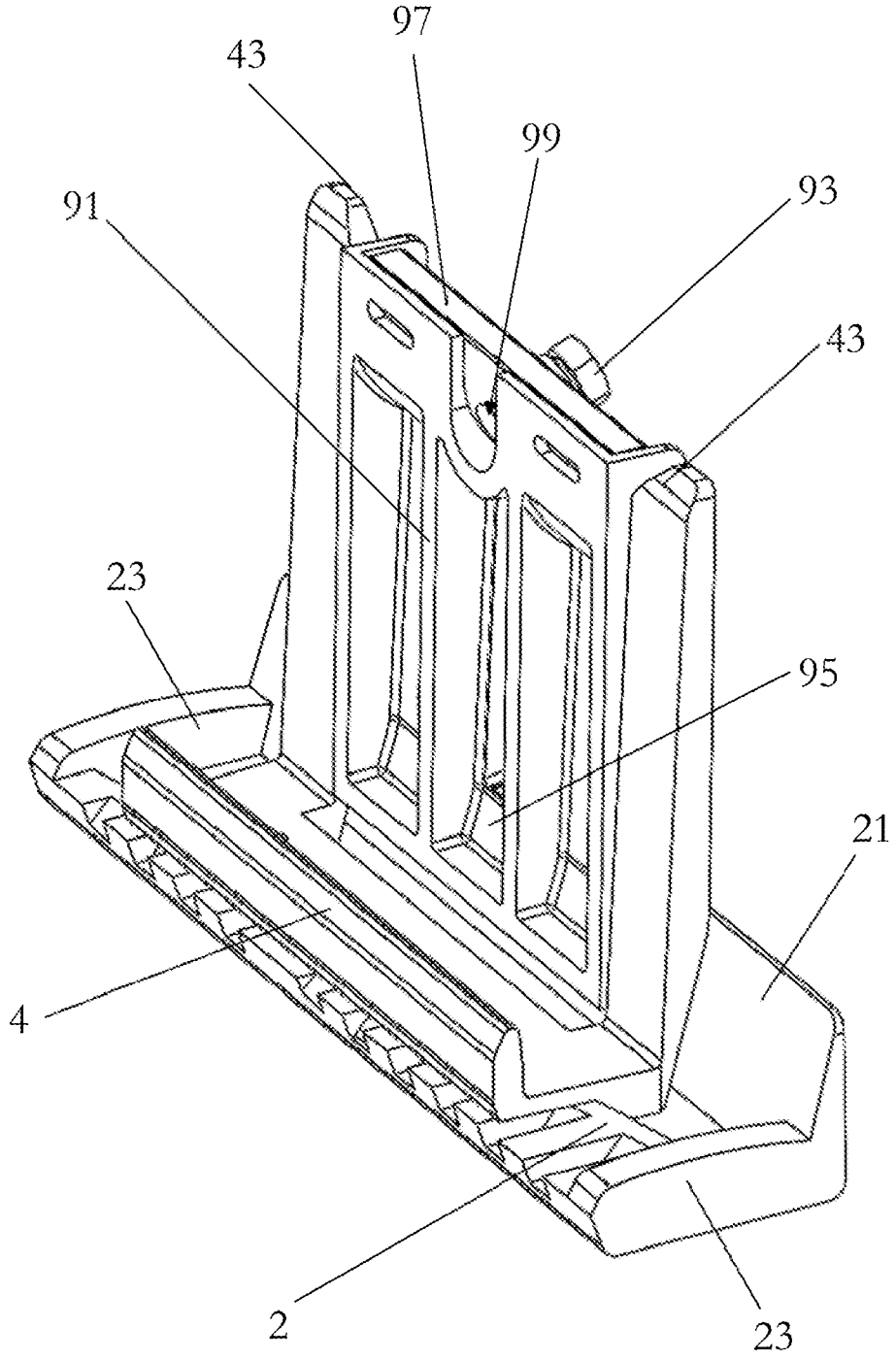
FIG. 3 shows the components of FIG. 2, but with the panel absent.

FIG. 3 shows the components of FIG. 2 from the opposite side, but with the panel 1 absent for clarity. The panel socket 4 into which the panel 1 would be inserted has the tabs 43 extending on either side thereof.

The panel socket 4 sits in the tray 2, and in particular engages with two angled ramps that extend the entire interior length of the base of the tray 2. The tray 2 has end walls 23, which extend upwards from the base of the tray 2 at each longitudinal end. With the panel inserted into the panel socket 4, the bottom edge of the panel 1 rests upon end walls 23.

The wedge 95 is shown in contact with the upwardly extending wall 21, and the entire contact surface of the contact pad 91 can be seen extending from the wedge 95 all the way to the plate 97. The aperture 99 into which the bolt 93 is inserted is visible extending through the contact pad 91, though this is not strictly necessary, as the aperture may not be a through-hole, which would prevent accidental damage to the panel 1 due to over-insertion of the bolt 93 into the aperture 99.

Figure 4:
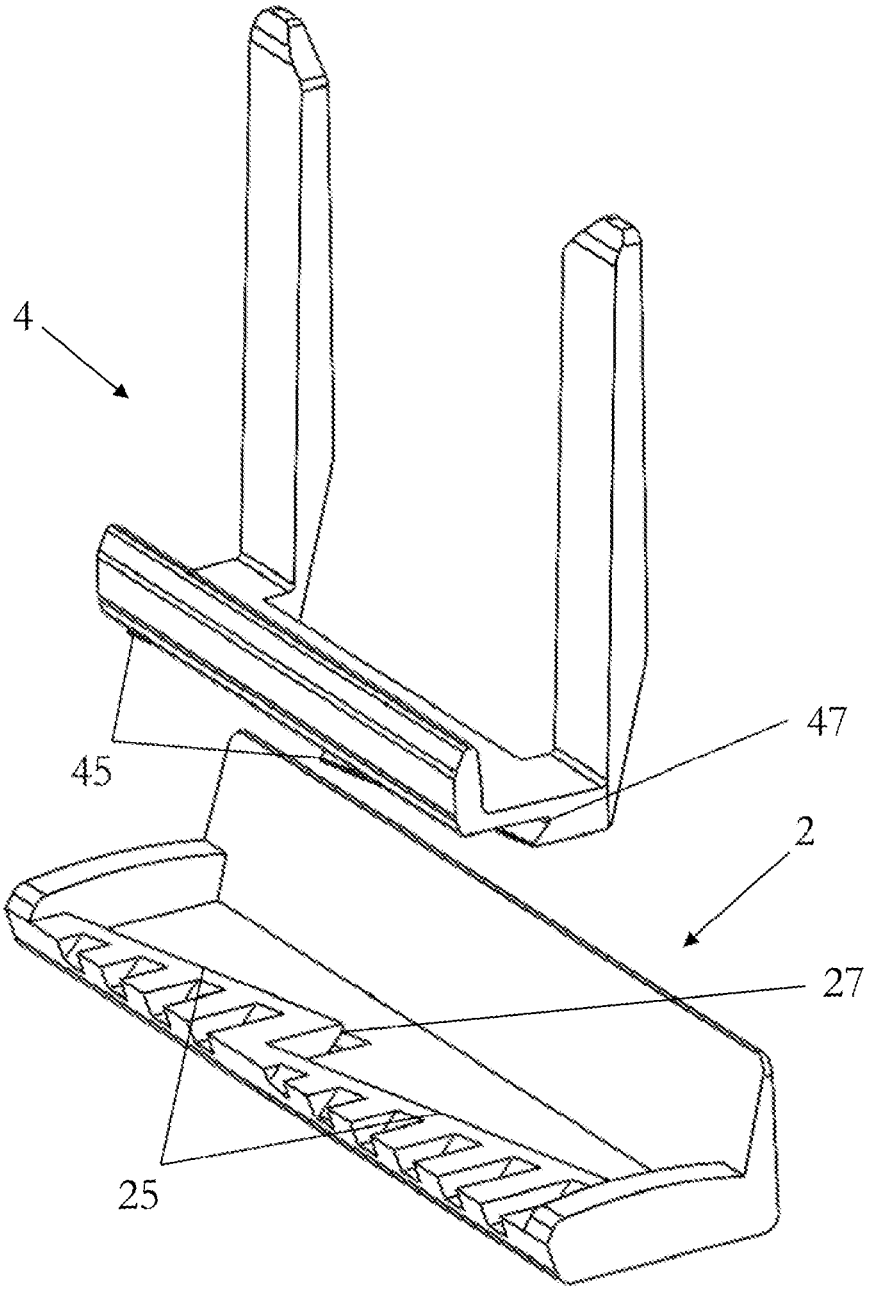
FIG. 4 is a different exploded view of just the tray and panel socket of FIG. 3.

FIG. 4 is a different exploded view of just the tray and panel socket of FIG. 3, showing the panel socket 4 above the tray 2. Two angled ramps 25 are shown on the base of the tray 2. In addition, a corresponding ramped surface 45 is shown on the underside of the panel socket 4 for engagement with the angled ramps 25 of the tray 2. The angled ramps 25 and the corresponding ramped surface 45 share the same angles of inclination, so that relative movement therebetween is enabled. In a vertical cross-section, the angled ramps 45 of the panel socket 4 have a lip 47, which prevents any relative vertical movement and/or vertical detachment of the panel socket 4 and the tray 2. The angled ramps 25 of the tray have a corresponding lip 27.

Figure 5:
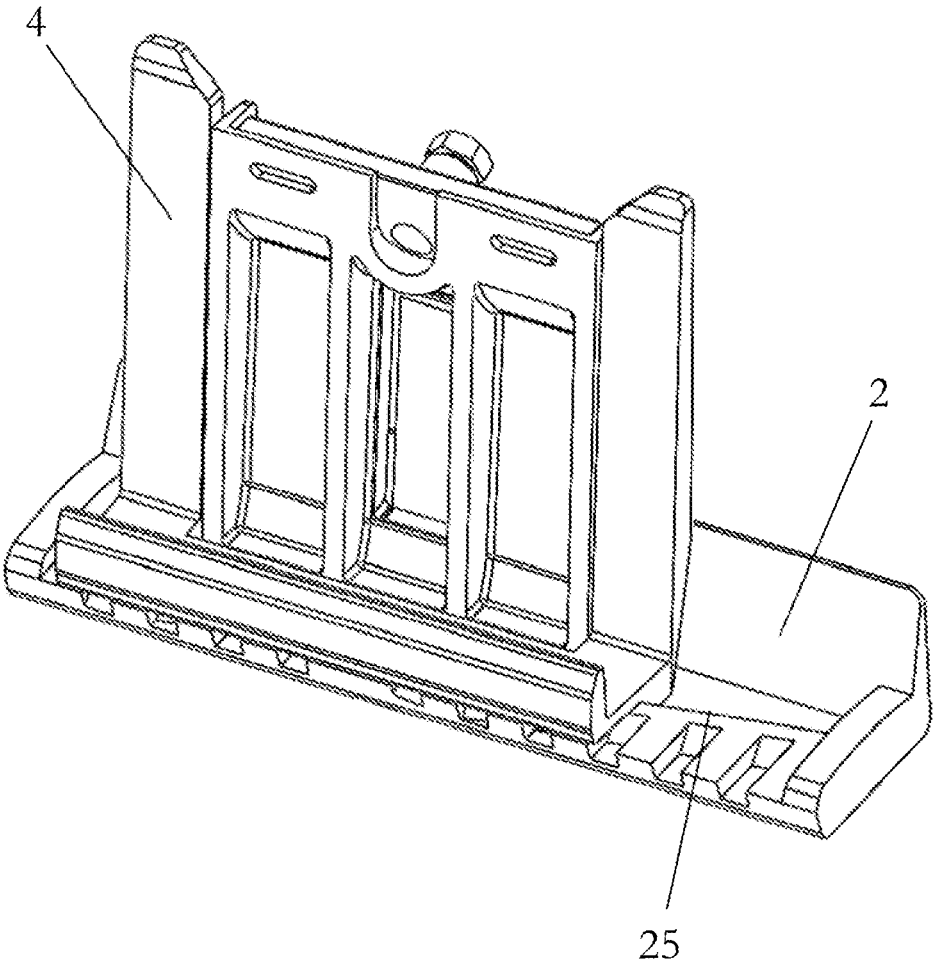
FIG. 5 shows the components of FIG. 3, but with the panel socket slid to the left of the tray.

FIG. 5 shows the components of FIG. 3, but with the panel socket slid to the left of the tray. By virtue of the angled ramps 25 and corresponding ramped surface 45, the panel socket 4 may be slid relative to the tray 2. In the example shown with the panel socket 4 slid to the left of the tray 2, this moves the panel socket 4 laterally, out of the page relative to the tray 2.

Figure 6:
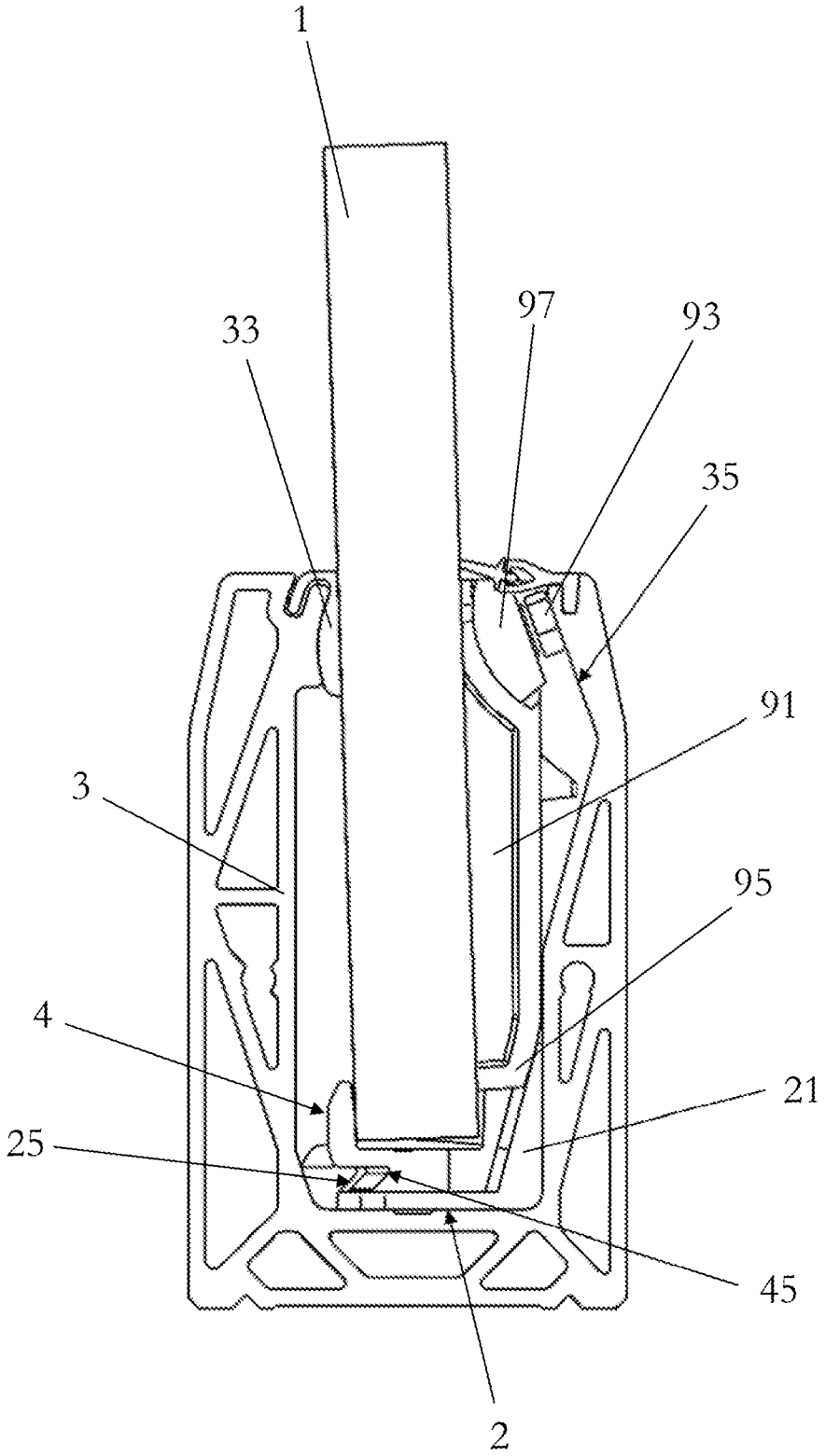
FIG. 6 is a cross-sectional view through the system of FIG. 1 assembled and with the panel inclined to the left.

FIG. 6 is a cross-sectional view through the system of FIG. 1 assembled and with the panel inclined to the left. Specifically, the cross-section is taken in a vertical slice through the centre of the plate 97. In this arrangement the panel socket 4 has been moved into the page, such that the ramped surface 45 pushes against the corresponding angled ramps 25 of the tray 2, moving the panel socket 4 (and thereby the base of the panel 1) to the right of the page.

The panel 1 pivots about a pivotable contact pad 33, such that the entire panel 1 inclines to the left of the page. In order to hole the panel 1 in this position, the bolt 93 is extended out of the aperture in the plate 97 such that the head of the bolt 93 engages with an inwardly- and downwardly-facing portion 35 of the side wall of the trough 3. This pushes the plate 97 away from the portion 35 of the side wall, and thereby pushes the contact pad 91 against the panel 1 in order to clamp the panel 1 in place between the contact pad 91 and the pivotable contact pad 33.

In addition, the downward component of the force from the bolt 93 urges the contact pad 91 downward to engage the wedge 95 with the upwardly extending wall 21 of the tray 2. The bracing by the wedge 95 holds the tray 5 in place, and thereby holds the post socket 4 in place, preventing further movement thereof.

Figure 7:
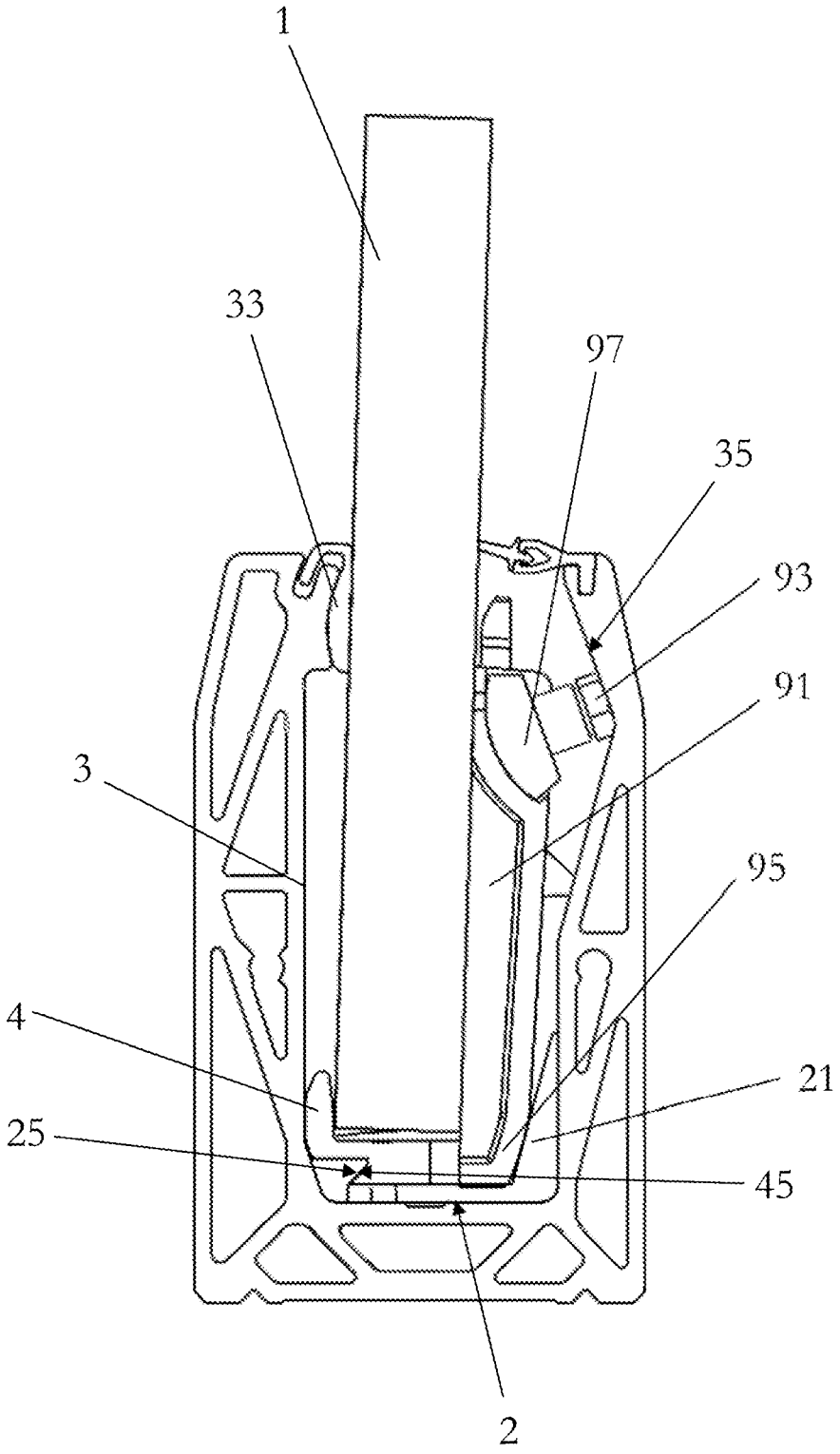
FIG. 7 is a cross-sectional view similar to FIG. 6, but with the panel inclined to the right.

FIG. 7 is a cross-sectional view similar to FIG. 6, but with the panel inclined to the right. Specifically, the panel socket 4 has been moved out of the page, such that the ramped surface 45 pushes against the corresponding angled ramps 25 of the tray 2, moving the panel socket 4 (and thereby the base of the panel 1) to the left of the page.

The panel 1 pivots about a pivotable contact pad 33, such that the entire panel 1 inclines to the right of the page. In order to hole the panel 1 in this position, the bolt 93 is extended out of the aperture 99 in the plate 97 such that the head of the bolt 93 engages with an inwardly- and downwardly-facing portion 35 of the side wall of the trough 3; however, in this configuration, the bolt 93 engages further down the portion 35 of the side wall of the trough 3. This pushes the plate 97 away from the portion 35 of the side wall, and thereby pushes the contact pad 91 against the panel 1 in order to clamp the panel 1 in place between the contact pad 91 and the pivotable contact pad 33.

In addition, the downward component of the force from the bolt 93 urges the contact pad 91 downward to engage the wedge 95 with the upwardly extending wall 21 of the tray 2. The bracing by the wedge 95 holds the tray 2 in place, and thereby holds the panel socket 4 in place, preventing further movement thereof.

Figure 8:
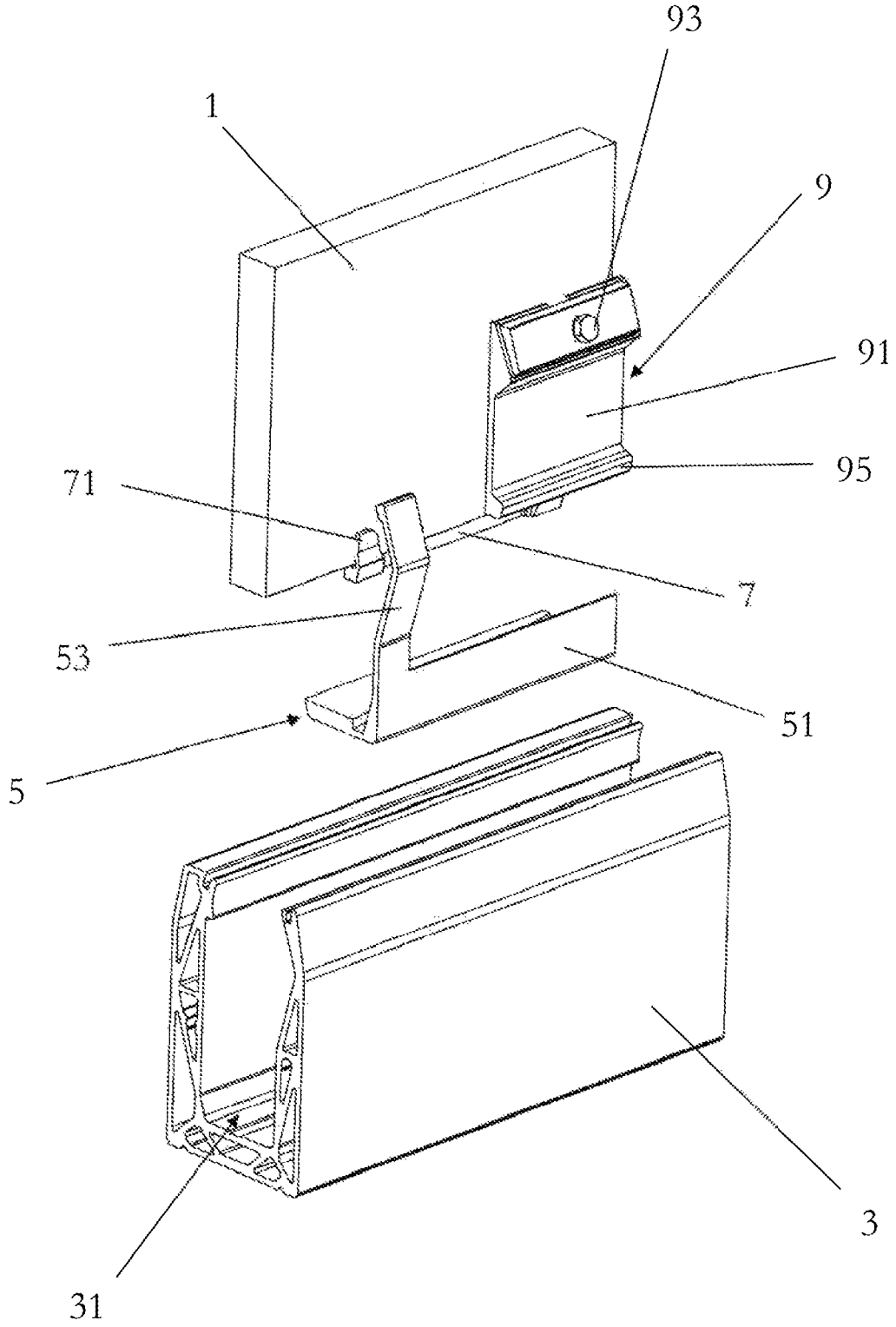
FIG. 8 is an exploded view of an alternative system for adjusting the alignment of a flat panel.

FIG. 8 is an exploded view of an alternative system for adjusting the alignment of a flat panel 1. The flat panel 1 is shown with significantly reduced height and length than would be typical, purely for the sake of clarity. In fact, a single panel may be gripped by multiple such systems along its length.

The system includes a trough 3, into which the flat panel 1 is to be mounted. A sliding tray 5 having an upwardly extending wall 51 and a tab 53 is shown ready to be inserted into the base 31 of the trough 3. A panel socket 7 is shown gripping the base of the panel 1, with fingers 71 wrapping around the sides of the panel 1. A clamping part 9 is shown next to the panel 1, and includes a panel contact pad 91, an adjustment part 93 and releasable wedge 95.

Figure 9:
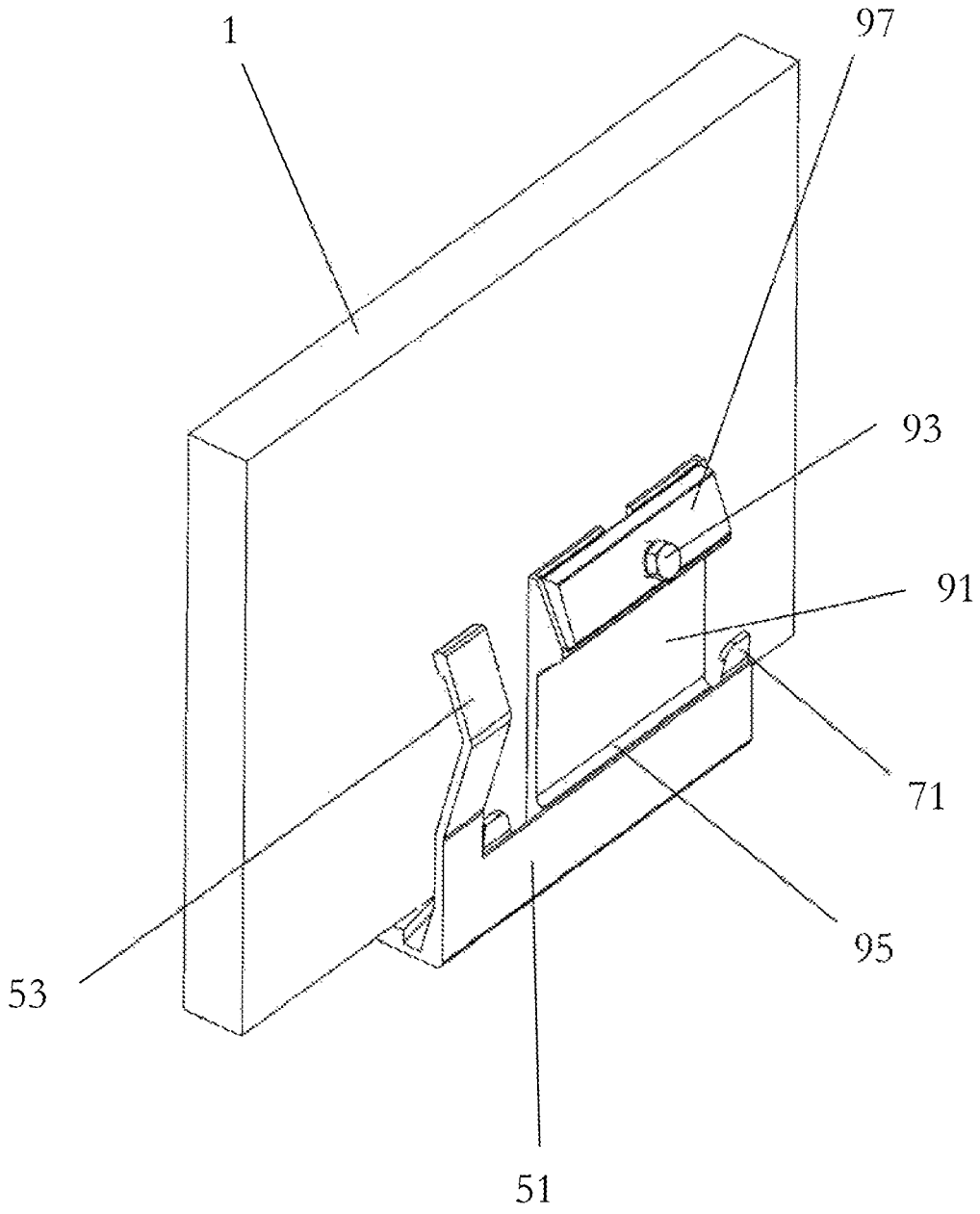
FIG. 9 shows the alternative system of FIG. 8 partially assembled, but with the trough absent.

FIG. 9 shows the system of FIG. 8 partially assembled on the panel 1, but with the trough 3 absent. The panel 1 is shown with the fingers 71 of the panel socket extending around the sides of the panel 1. The panel socket 7 is itself engaged in the sliding tray 5.

The contact pad 91 of the clamping part 9 is shown in contact with the panel 1 over the entire height of the contact pad 91. The releasable wedge 95 is located in contact with the panel 1 (by virtue of the contact pad 91, or which it forms part) and in contact with the interior of the upwardly extending wall 51 of the sliding tray 5.

The adjustment part 93 is shown as a hexagonal head of a bolt, the bolt passing through an internally-threaded aperture (not shown) in a plate 97. The plate 97 acts to spread a force from the bolt over the entire width of the contact pad 91. The bolt extends into the aperture at an oblique angle; that is, extending in part horizontally (toward the panel) and in part vertically (toward the base of the trough). The bolt head is configured to abut an interior of the trough when extended out from the aperture, such that the bolt pushes the plate 97, and thereby the contact pad 91 into contact with the panel 1, and also pushes the contact pad 91 downward. The downward action of the contact pad 91 acts to urge the panel 1 into the base of the trough, and also acts to urge the wedge 95 into bracing the panel 1 against the upwardly extending wall 51.

Figure 10:
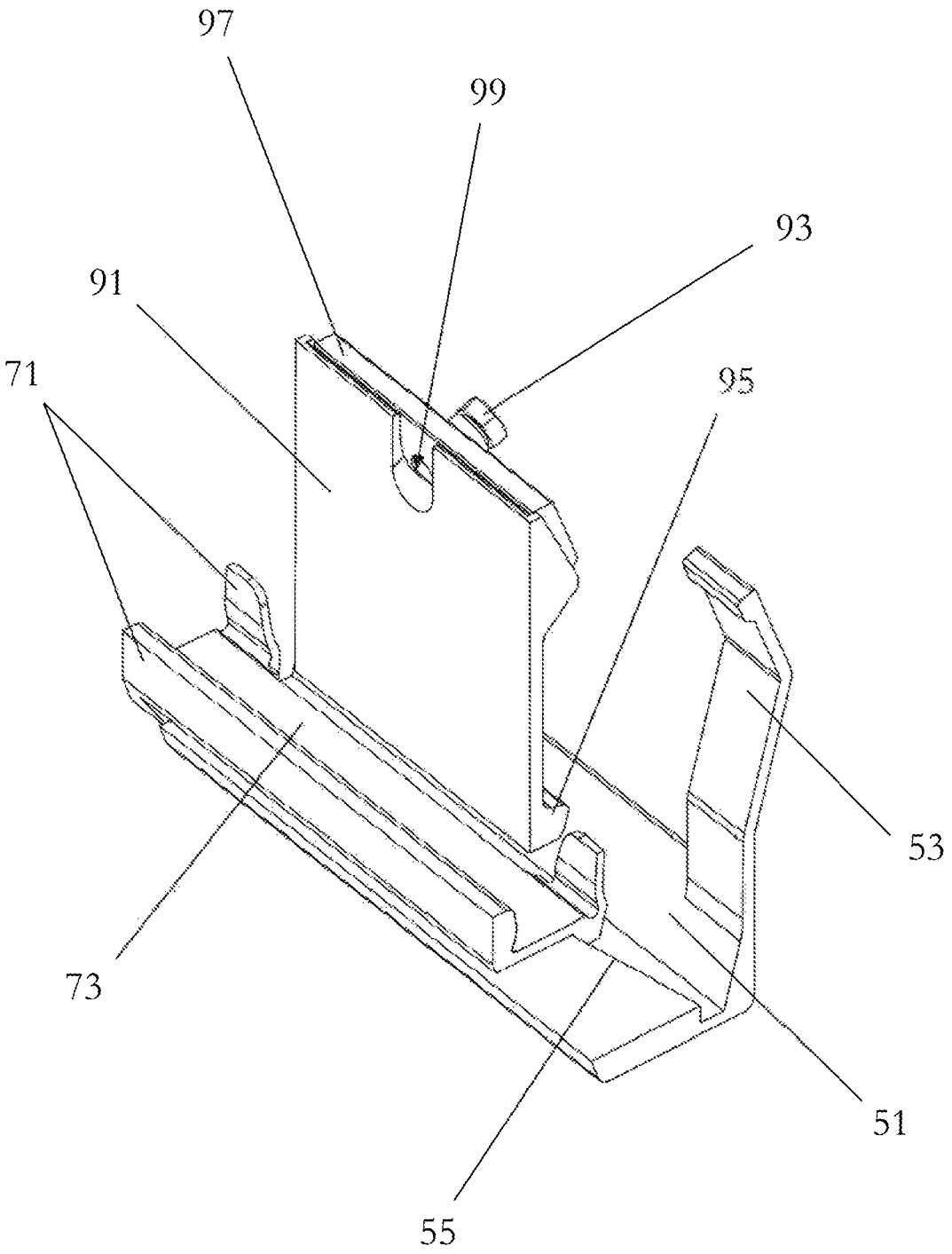
FIG. 10 shows the components of FIG. 9, but with the panel absent.

FIG. 10 shows the components of FIG. 2 from the opposite side, but with the panel 1 absent for clarity. The panel socket 7 into which the panel 1 would be inserted has the fingers 71 extending on either side thereof, and also is provided with a bottom 73 onto which the panel rests.

The panel socket 7 sits in the sliding tray 5, and in particular engages with an angled ramp 55 that extends the entire length of the tray, beginning close to the upwardly extending wall 51 (next to the tab 53) and ending distal from the upwardly extending wall 51 at the opposite end.

The wedge 95 is shown in contact with the upwardly extending wall 51, and the entire contact surface of the contact pad 91 can be seen extending from the wedge 95 all the way to the plate 97. The aperture 99 into which the bolt 93 is inserted is visible extending through the contact pad 91, though this is not strictly necessary, as the aperture may not be a through-hole, which would prevent accidental damage to the panel 1 due to over-insertion of the bolt 93 into the aperture 99.

Figure 11:
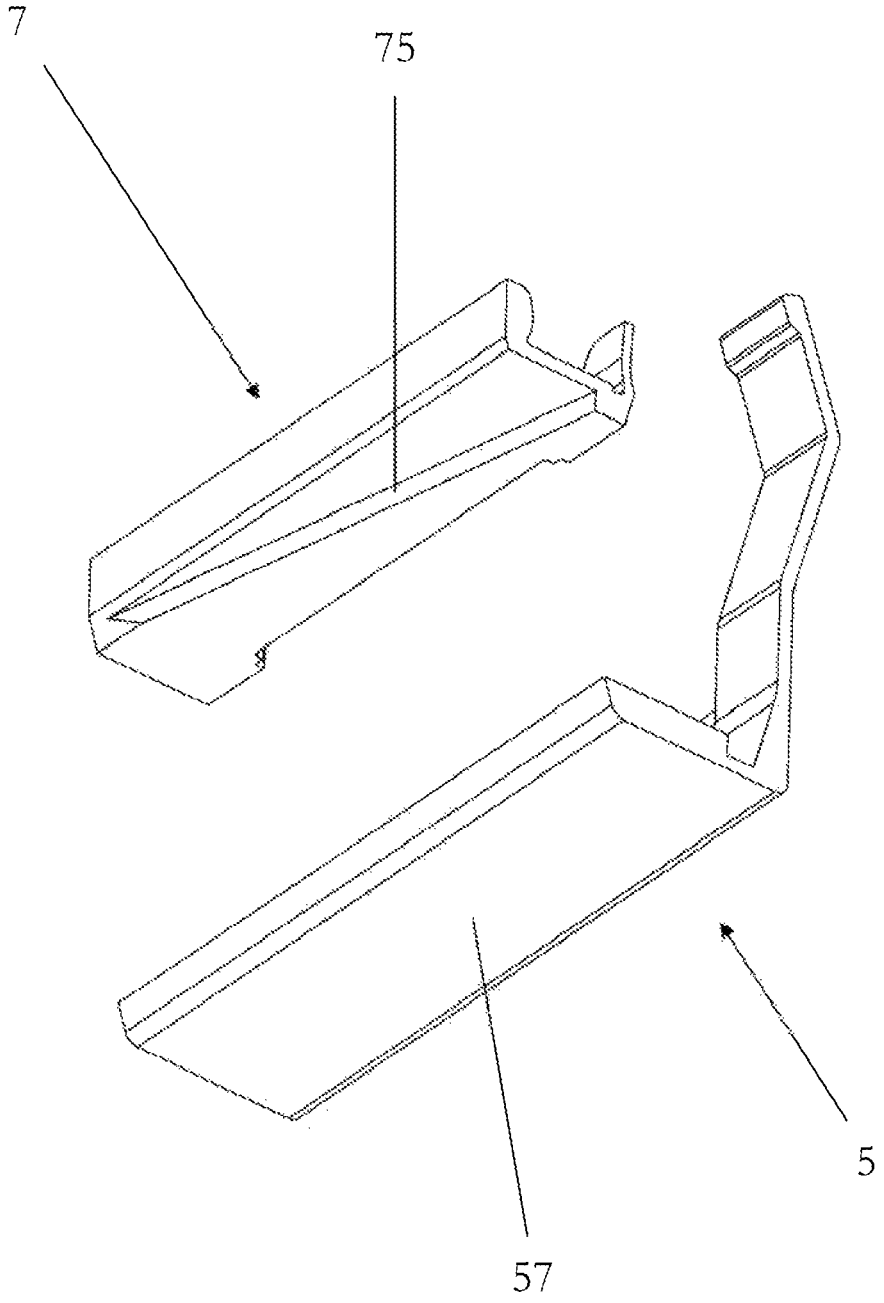
FIG. 11 is a different exploded view of just the tray and panel socket of FIG. 10, as seen from beneath.

FIG. 11 is a different exploded view of just the sliding tray 5 and panel socket 7 of FIG. 3, as seen from beneath. Specifically, a sliding surface 57 for sitting on the base of the trough is shown on an underside of the sliding tray 5. In addition, a corresponding ramped surface 75 is shown on the underside of the panel socket 7 for engagement with the angled ramp 55 of the sliding tray 5 shown in FIG. 3. The angled ramp 55 and the corresponding ramped surface 75 share the same constant angle of inclination, so that relative movement therebetween is enabled.

Figure 12:
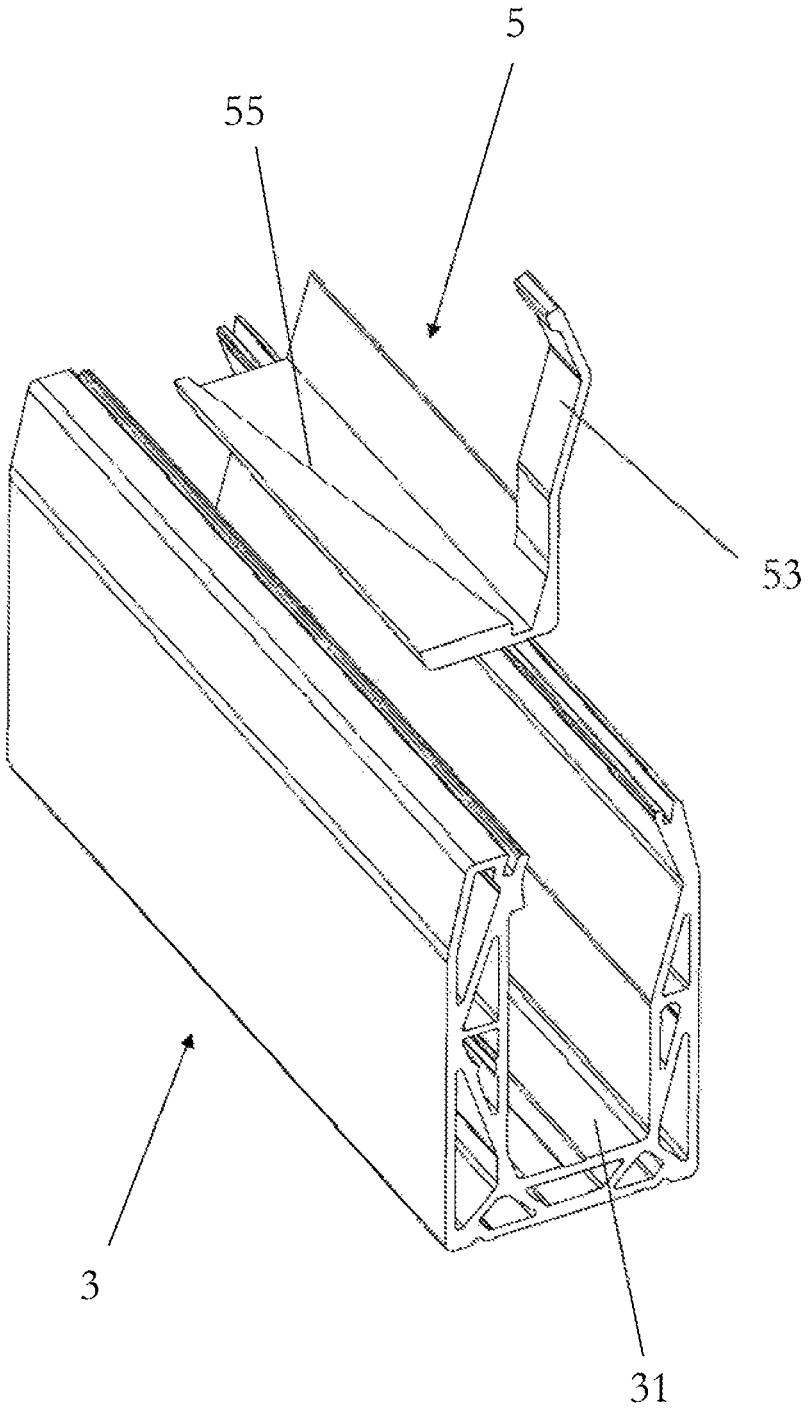
FIG. 12 is a further different exploded view of just the tray and the trough.

FIG. 12 shows the sliding tray 5 before insertion into the base 31 of the trough 3. As can be seen, the tab 53 is shaped to conform to the interior profile of the trough 3, and in particular a side wall thereof, to aid access to the panel socket 7 and clamping part 9, once inserted. Also visible is the entire length of the angled ramp 55.

Figure 13:
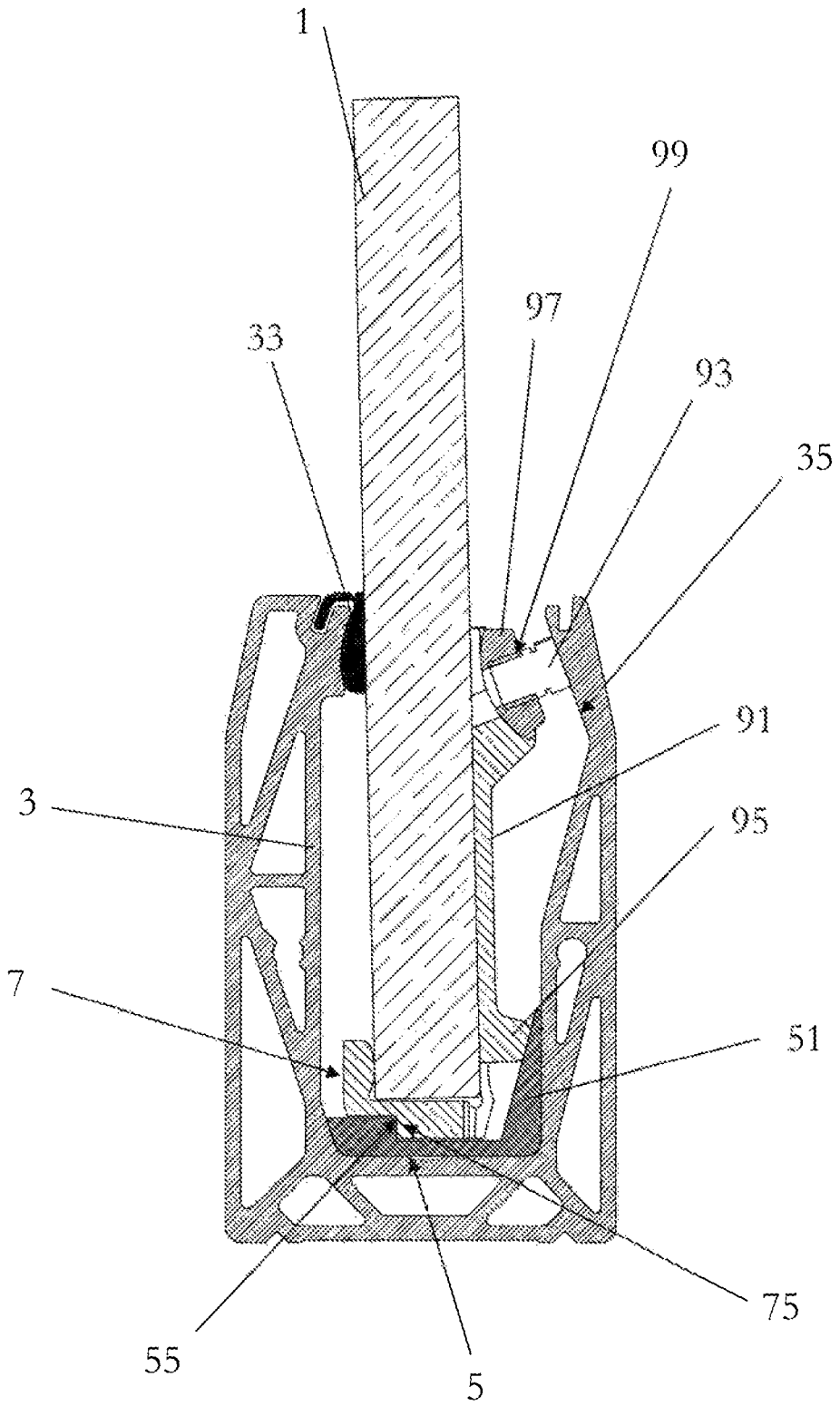
FIG. 13 is a cross-sectional view through the alternative system of FIG. 8 assembled and with the panel inclined to the left.

FIG. 13 is a cross-sectional view through the system of FIG. 8 assembled and with the panel inclined to the left. Specifically, the cross-section is taken in a vertical slice through the bolt 93. In this arrangement the sliding tray 5 has been moved into the page by the tab (not shown), such that the angled ramp 55 pushes against the corresponding ramped surface 75 of the panel socket 7, moving the panel socket 7 (and thereby the base of the panel 1) to the right of the page.

The panel 1 pivots about a pivotable contact pad 33, such that the entire panel 1 inclines to the left of the page. In order to hole the panel 1 in this position, the bolt 93 is extended out of the aperture 99 in the plate 97 such that the head of the bolt 93 engages with an inwardly- and downwardly-facing portion 35 of the side wall of the trough 3. This pushes the plat 97 away from the portion 35 of the side wall, and thereby pushes the contact pad 91 against the panel 1 in order to clamp the panel 1 in place between the contact pad 91 and the pivotable contact pad 33.

In addition, the downward component of the force from the bolt 93 urges the contact pad 91 downward to engage the wedge 95 with the upwardly extending wall 51 of the sliding tray 5. The bracing by the wedge 95 holds the sliding tray 5 in place, preventing further movement thereof, even if such movement is intended by a user manipulation the tab.

Figure 14:
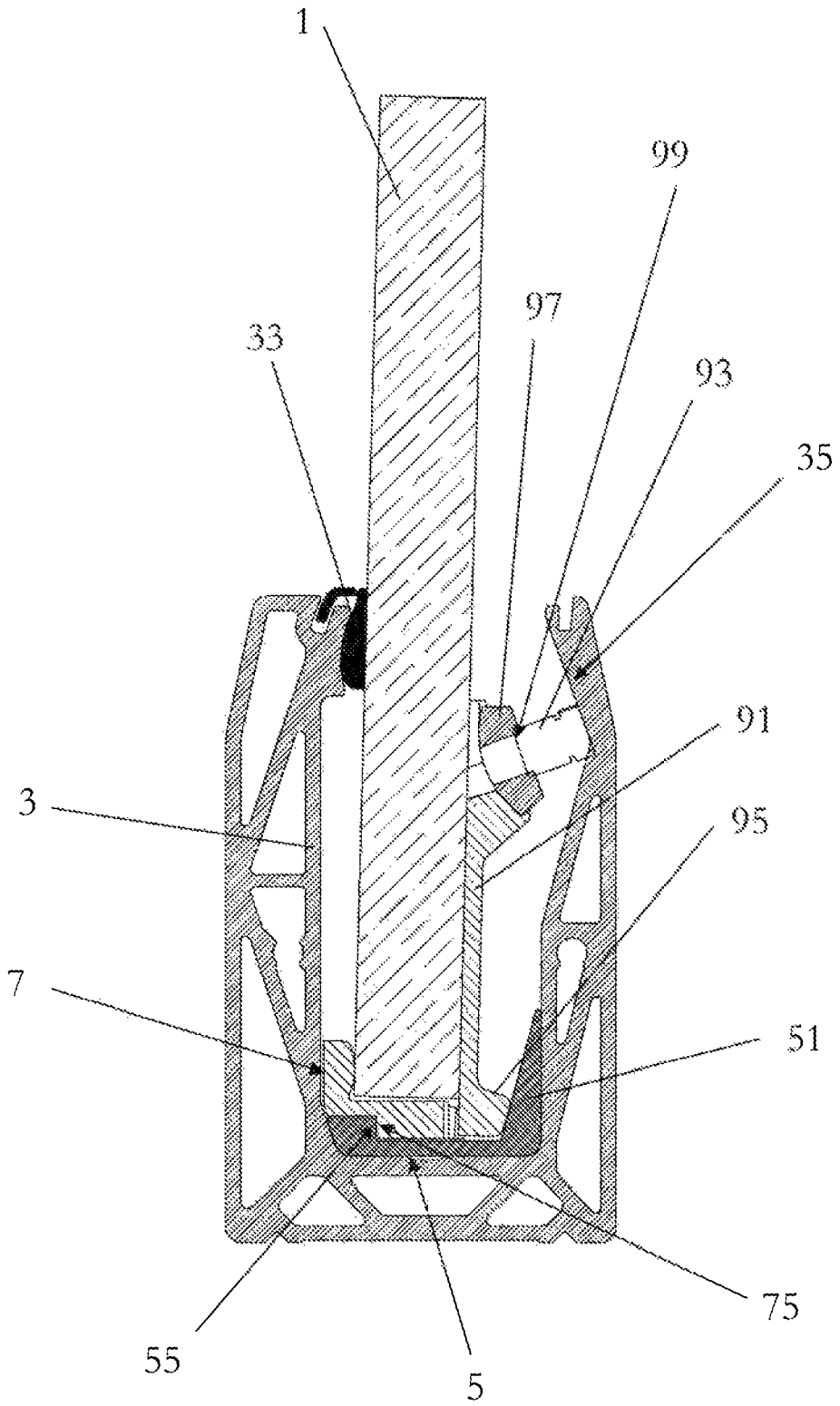
FIG. 14 is a cross-sectional view similar to FIG. 13, but with the panel inclined to the right.

FIG. 14 is a cross-sectional view similar to FIG. 13, but with the panel inclined to the right. Specifically, the sliding tray 5 has been moved out of the page by the tab (not shown), such that the angled ramp 55 pushes against the corresponding ramped surface 75 of the panel socket 7, moving the panel socket 7 (and thereby the base of the panel 1) to the left of the page.

The panel 1 pivots about a pivotable contact pad 33, such that the entire panel 1 inclines to the right of the page. In order to hole the panel 1 in this position, the bolt 93 is extended out of the aperture 99 in the plate 97 such that the head of the bolt 93 engages with an inwardly- and downwardly-facing portion 35 of the side wall of the trough 3; however, in this configuration, the bolt 93 engages further down the portion 35 of the side wall of the trough 3. This pushes the plat 97 away from the portion 35 of the side wall, and thereby pushes the contact pad 91 against the panel 1 in order to clamp the panel 1 in place between the contact pad 91 and the pivotable contact pad 33.

In addition, the downward component of the force from the bolt 93 urges the contact pad 91 downward to engage the wedge 95 with the upwardly extending wall 51 of the sliding tray 5. The bracing by the wedge 95 holds the sliding tray 5 in place, preventing further movement thereof, even if such movement is intended by a user manipulation the tab.

The invention claimed is:

1. A system for adjusting the alignment of a flat panel, the system comprising:

a longitudinal trough having a longitudinal axis extending longitudinally along the trough and a lateral axis perpendicular to the longitudinal axis and extending laterally across the trough, the trough having two opposing side walls disposed laterally on opposing sides of the longitudinal axis and extending parallel to the longitudinal axis and a base connected between the opposing side walls such that the base extends parallel to the longitudinal axis and parallel to the lateral axis, the trough being open on a side opposing the base, the trough configured to be attachable to a surface;

a tray disposed within the base of the trough, the tray comprising a wall extending upward from the base of the trough adjacent to a first one of the side walls of the trough;

a panel socket configured to receive a base of a flat panel therein, the panel socket configured to grip the base of the flat panel, the panel socket and tray arranged to be slidable relative to one another, wherein the panel socket is configured to engage with the tray such that movement of the panel socket or the tray relative to one another in a direction parallel to the longitudinal axis along the trough results in the panel socket moving in a direction parallel to the lateral axis across the trough;

a clamp configured to hold the panel within the trough adjacent to the open side of the trough; and a releasable wedge configured to brace the panel within the trough adjacent to the base of the trough, the wedge configured to bridge a gap between the base of the flat panel and the wall of the tray.

2. The system according to claim 1, wherein the panel socket and the tray are provided with respective cooperating angled ramps against which the panel socket and the tray may slide relative to one another.

3. The system according to claim 1, wherein the clamp comprises a first jaw and a second jaw, the second jaw configured to be moveable toward the first jaw to grip a panel therebetween.

4. The system according to claim 1, in which the clamp produces a force having a bedding component that acts along the panel toward the base of the trough.

5. The system according to claim 4, wherein the bedding component of the force from the clamp acts to urge the releasable wedge into the gap between the base of the flat panel and the wall of the tray.

6. A method for adjusting the alignment of a flat panel, the method comprising the steps of:

providing the system according to claim 1;

placing a flat panel in the panel socket;

sliding the panel socket and tray relative to one another in a direction parallel to the longitudinal axis along the trough, thereby moving the panel socket in a direction parallel to the lateral axis across the trough;

holding the panel with the clamp adjacent to the open side of the trough; and bracing the panel with the releasable wedge adjacent to the base of the trough.

7. A system for adjusting the alignment of a flat panel, the system comprising:

a longitudinal trough having a longitudinal axis extending longitudinally along the trough and a lateral axis perpendicular to the longitudinal axis and extending laterally across the trough, the trough having two opposing side walls disposed laterally on opposing sides of the longitudinal axis and extending parallel to the longitudinal axis and a base connected between the opposing side walls such that the base extends parallel to the longitudinal axis and parallel to the lateral axis, the trough being open on a side opposing the base, the trough configured to be attachable to a surface;

a tray disposed within the base of the trough;

a panel socket configured to receive a base of a flat panel therein, the panel socket configured to grip the base of the flat panel, the panel socket arranged to be slidable along the trough in a longitudinal direction, wherein the panel socket is configured to engage with the tray such that movement of the panel socket along the trough in a direction parallel to the longitudinal axis results in the panel socket moving in a direction parallel to the lateral axis across the trough; and a clamp configured to hold the panel within the trough adjacent to the open side of the trough.

8. A method for adjusting the alignment of a flat panel, the method comprising the steps of:

providing the system according to claim 7;

placing a flat panel in the panel socket;

sliding the panel socket in a direction parallel to the longitudinal axis along the trough, thereby moving the panel socket in a direction parallel to the lateral axis across the trough; and holding the panel with the clamp adjacent to the open side of the trough.

* * * * *